US005281167A

United States Patent [19]

Le et al.

[11] Patent Number: 5,281,167

[45] Date of Patent: Jan. 25, 1994

[54] COAXIAL CONNECTOR FOR SOLDERING TO SEMIRIGID CABLE

[75] Inventors: Lang T. Le, Camp Hill; Michael E. Pastal, Lebanon, both of Pa.

[73] Assignee: The Whitaker Corporation, Wilmington, Del.

[21] Appl. No.: 68,876

[22] Filed: May 28, 1993

[51] Int. Cl.[5] ..... H01R 13/00

[52] U.S. Cl. ..... 439/578; 439/874

[58] Field of Search ..... 439/578-585, 439/874

[56] References Cited

U.S. PATENT DOCUMENTS

| | | | |
|---|---|---|---|
| 3,676,573 | 7/1972 | Avery | 439/320 |
| 3,764,959 | 10/1973 | Toma et al. | 439/584 |
| 4,540,231 | 9/1985 | Forney, Jr. | 339/94 C |
| 4,545,637 | 10/1985 | Bossard et al. | 439/874 |
| 4,557,546 | 12/1985 | Dreyer | 339/177 R |
| 4,583,811 | 4/1986 | McMills | 339/177 R |
| 4,596,434 | 6/1986 | Saba et al. | 439/578 |
| 4,688,877 | 8/1987 | Dreyer | 439/584 |
| 4,834,676 | 5/1989 | Tackett | 439/584 |
| 5,002,503 | 3/1991 | Campbell et al. | 329/578 |
| 5,007,861 | 4/1991 | Stirling | 439/578 |
| 5,021,010 | 6/1991 | Wright | 439/874 |
| 5,052,946 | 10/1991 | Homolka | 439/584 |

*Primary Examiner*—Joseph H. McGlynn
*Attorney, Agent, or Firm*—Anton P. Ness

[57] ABSTRACT

A retention sleeve (140) placed over the rearward end (116) of the outer (102) of a coaxial plug connector (100) providing a rearward stop for retaining the coupling nut (126) on the housing. The retention sleeve includes an inwardly directed flange (146) along the cable-receiving passageway therethrough for retention of solder preforms (128) within cable-receiving bore (114) of the outer conductive housing (102). The retention sleeve can be of low resistance copper having a thin outer layer (152) of magnetic high resistance metal, defining a self-regulating temperature thermal energy source when subjected to RF current, to reflow solder. A recess (154) in rearward portion (148) of retention sleeve (140) provides a site for an additional preform (156) of solder which when reflowed defines a robust solder joint (176,178) of the outer conductor (162) of the cable (160) to not only the outer conductive housing (102) but also axially forwardly and rearwardly of the annular flange (146) of the retention sleeve (140).

1 Claim, 4 Drawing Sheets

COAXIAL CONNECTOR FOR SOLDERING TO SEMIRIGID CABLE

FIELD OF THE INVENTION

This relates to electrical connectors and more particularly to coaxial connectors for semirigid coaxial cable.

BACKGROUND OF THE INVENTION

Certain connectors for coaxial cable which are commercially available, include a coupling nut assembled to the outer conductive shell which threadedly couples with the outer conductive shell of a mating connector to bring together and retain the connectors in an assuredly mated condition to interconnect a coaxial cable to another like cable or to an electrical apparatus or the like. The connector includes an inner contact or inner conductor within a dielectric sleeve all within the outer conductive shell. The inner contact is electrically engageable with a contact terminated onto the signal conductor of the coaxial cable, which is disposed within an insulative jacket, all within an outer cable conductor. Certain coaxial cable has a semirigid outer conductor such as of copper alloy, and the outer conductive shell of the connector is commonly soldered to the semirigid conductor; the center conductor of the cable includes an end section extending forwardly from the cable end and is commonly received into and mated with a rearward socket section of the inner contact of the connector. The coupling nut is secured to the outer conductive shell in a manner permitting rotation thereabout but is stopped from axial movement therealong; the coupling nut is rotated about the first connector to become fully threaded to the mating connector, incrementally drawing the mating connector toward the first connector and its mating face firmly against the mating face of the first connector for the complementary inner and outer conductors to become electrically connected.

One particular such coaxial connector is disclosed in U.S. Pat. No. 5,232,377. A retention sleeve is disclosed therein to be placed on the outer conductive shell and includes a forward end which defines the rearward stop for coupling nut retention. The retention sleeve includes an inner diameter which is incrementally smaller than the outer diameter of the rearward section of the outer conductive shell to establish an interference fit with at least a portion of the rearward section. The retention sleeve further includes an inwardly directed annular flange at the rearward end thereof which abuts the end of the rearward shell section for controllably locating the fully assembled position of the retention sleeve on the outer conductive shell.

In the connector of U.S. Pat. No. 5,232,377, the bore of the rearward section of the outer conductive shell includes a larger diameter rearward bore portion providing a seat for placement of an annular solder preform or ring thereinto prior to placement of the retention sleeve onto the outer conductive shell. Preferably the periphery of the apertures through the inwardly directed annular flange of the rearward end of the retention sleeve is chamfered to form a lead-in to facilitate insertion therethrough of the end of the semirigid coaxial cable.

Further, the retention sleeve is composed of low resistance non-magnetic metal; the outwardly facing surface of the retention sleeve includes a thin layer of high resistance magnetic material integrally joined thereonto. So fabricated, the retention sleeve defines a Curie point heater of the type disclosed in U.S. Pat. No. 4,852,252. Such a heater is a self-regulating temperature thermal energy source achieving a temperature sufficient to reflow solder when subjected to radiofrequency current, in the manner as is generally disclosed in U.S. Pat. Nos. 4,256,945 and 4,659,912. For cable termination, the connector assembly containing the solder preform therewithin receives the end of the semirigid cable into the rearward section thereof, which electrically engages the inner contact with the signal contact of the cable, and is then subjected to high frequency alternating current such as radiofrequency current (RF) of 13.56 megaHertz for several seconds. The self-regulating temperature heater defined by the retention sleeve generates thermal energy until a Curie point temperature is achieved such as about 240° C., a certain amount higher than the reflow temperature such as about 183° C. The thermal energy reflows the solder of the preform which flows along the surface of the semirigid cable and the inwardly directed annular flange of the retention sleeve to form a solder joint between the cable's outer conductor and the retention sleeve which is assuredly electrically joined to the outer conductive shell of the connector by the interference fit.

It is desired to obtain an assured solder joint of the semirigid cable outer conductor to a coaxial connector having a retention sleeve of the type containing solder therewithin.

SUMMARY OF THE INVENTION

The present invention is an improved coaxial connector for semirigid coaxial cable, of the general type having a retention sleeve secured to the rearward end of a rearwardly extending section of the outer conductive housing of the coaxial connector and which includes a radially inwardly directed annular flange at the cable-receiving of the retention sleeve, and where the rearward housing section includes a preform of solder secured therein by the radial annular flange of the retention sleeve. The improvement is provided by an axially extending flange which extends rearwardly from the radially extending annular flange of the retention sleeve of generally the same inner diameter as the forward portion of the retention sleeve, enabling a second solder preform to be disposed within the retention sleeve rearwardly of the radially extending annular flange. The additional solder, and its placement rearwardly of the annular flange, eliminates the possibility of any air gap adjacent the solder joint in the vicinity of the annular flange, resulting from the soldering operation.

It is an objective of the present invention to provide a coaxial connector solderable to semirigid coaxial cable adapted to provide an assured solder joint therewith.

It is a further objective for such a connector to be adapted to eliminate any air gap adjacent the solder joint with the cable outer conductor within the connector.

An embodiment of the invention will now be described by way of example with reference to the accompanying drawings.

DETAILED DESCRIPTION OF THE PREFERRED EMBODIMENT

Figure 1:
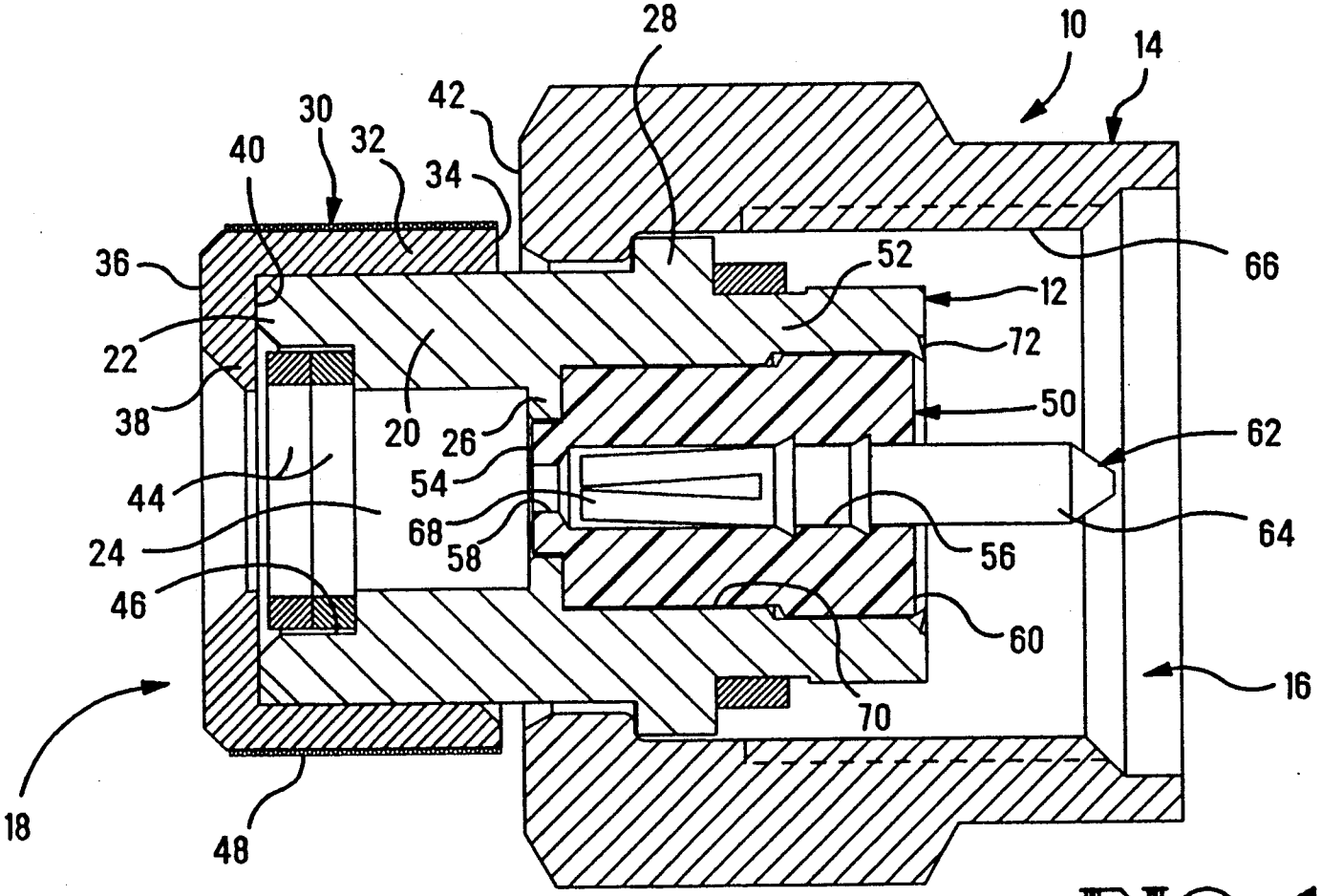
FIG. 1 Prior Art
FIG. 1 is an illustration of a PRIOR ART coaxial connector.

A PRIOR ART coaxial connector 10 is illustrated in FIG. 1 and includes a conductive shell or outer conductive housing 12 around which is disposed a coupling nut 14 and extends from a mating face 16 to a cable-receiving rearward face 18. Assembled within outer conductive housing 12 is a dielectric sleeve 50 containing an inner contact 62 held concentric within the inner surface of outer conductive housing 12. Outer conductive housing 12 includes rearwardly extending section 20 concluding in rearward cable-receiving end 22 and having defined therewithin a cable-receiving bore 24 into which an end of a semirigid cable will be received (shown in FIG. 3). Just forwardly of cable-receiving bore 24 is a radially inwardly extending annular flange 26 against which an end of the outer conductor of the semirigid cable will abut during assembly.

Affixed around rearward section 20 of outer conductive housing 12 is a retention sleeve 30 including a body section 32 extending from leading end 34 to rearward end 36. An inwardly directed annular flange 38 is fabricated at rearward end 36 and defines a forwardly facing surface 40. Body section 32 has an inner diameter just less than the outer diameter of rearward section 20 of outer conductive housing 12 and an axial length less than that of rearward section 20, so that when retention sleeve 30 is pushed onto rearward section 20 from rearward end 22, an interference fit is defined to retain retention sleeve 30 thereon with leading end 34 slightly spaced from rearward end 42 of coupling nut 14 to define a rearward axial stop for freely rotatable coupling nut 14, with collar 28 of outer conductive housing 12 defining a forward stop. When retention sleeve 30 is affixed onto rearward section 20, annular flange 38 serves to retain annular preforms 44 in the assembled connector, which are disposed within annular recess 46 along cable-receiving bore 24 at cable-receiving end 22.

With retention sleeve 30 comprised of low resistance copper alloy, a layer of metal 48 is defined on the outer surface of the sleeve and joined intimately thereto which is of metal having high resistance and high magnetic permeability, thereby defining a Curie point self-regulating temperature thermal energy source achieving a temperature sufficient to reflow the solder of preforms 44 when subjected to radiofrequency current during termination to the semirigid cable.

Dielectric sleeve 50 is secured within forward section 52 of outer conductor 12, having a reduced diameter axial flange 54 which extends through inwardly directed flange 26 to cable-receiving bore 24. Profiled centered passageway 56 extends from a small diameter portion 58 through axial flange 54 forwardly to forward sleeve end 60 and an inner contact 62 is secured therewithin. Inner contact 62 includes a front pin section 64 at mating face 16 extending forwardly of dielectric sleeve 50 and within threaded portion 66 of coupling nut 14 to mate with a complementary contact section of a mating connector (not shown); a socket contact section 68 is defined at the rearward end of inner contact 62 and is disposed within profiled passageway 56 aligned with small diameter passageway portion 58 to receive and mate with an end section of the inner conductor of a coaxial cable (see FIG. 3). Threaded forward portion 66 threadedly receives thereinto a correspondingly threaded outer surface of the conductive shell or outer conductive housing of a mating connector (not shown).

Dielectric sleeve 50 is secured within outer conductor 12 by being force fit into forward cavity 70 of forward section 52 and is seated against inwardly directed annular flange 26 of outer conductor 12, after which the leading end of the outer conductor is slightly staked at 72 over the periphery of forward end 60 of dielectric sleeve 50. When dielectric sleeve 50 with inner contact 62 secured therein is assembled within outer conductor 12, inner contact 62 is held precisely centered within the outer conductor, which has a precisely selected inside diameter in cooperation with a precisely selected outer diameter of dielectric sleeve 50 for optimum impedance performance.

Figure 2:
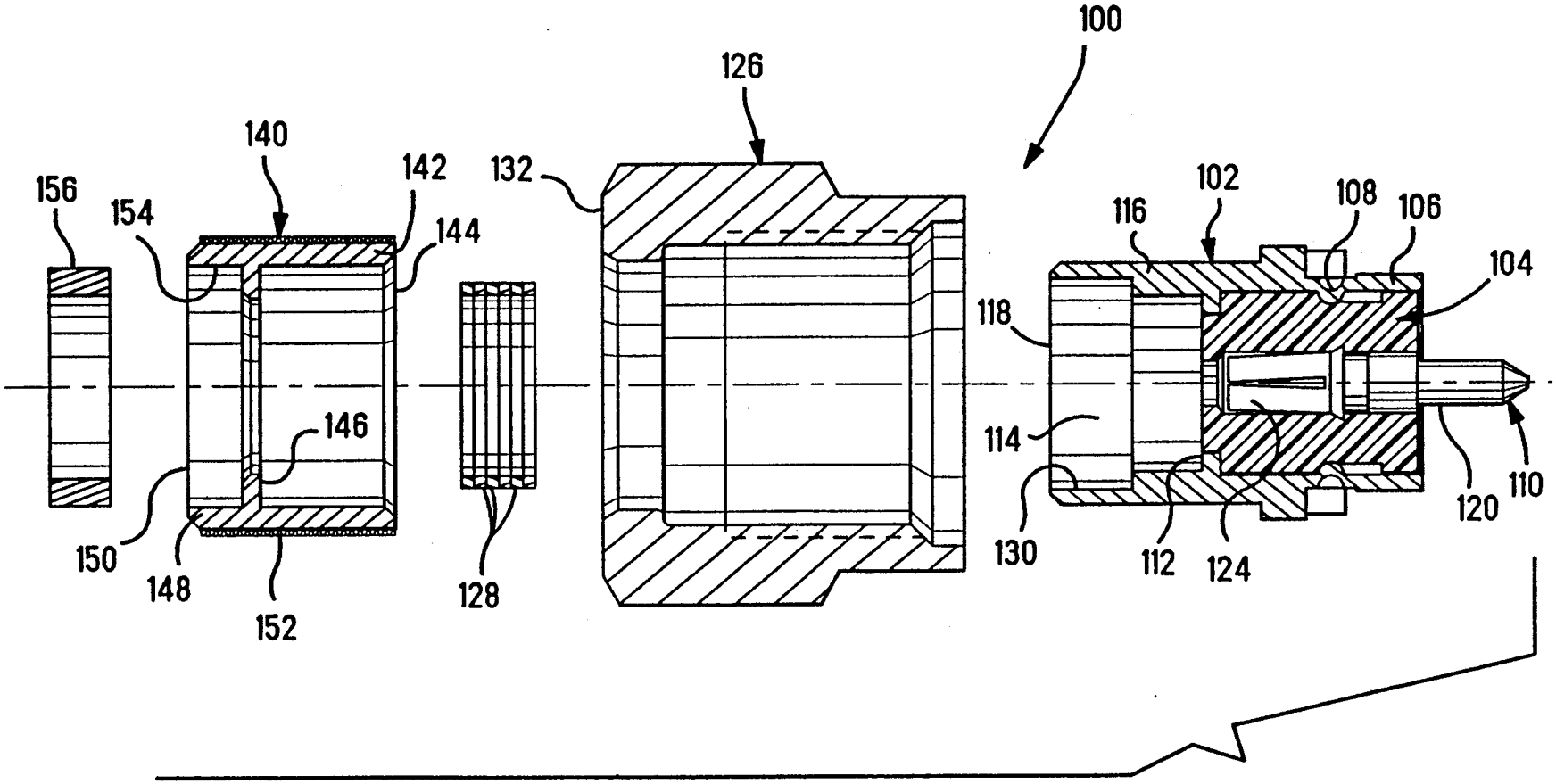
FIGS. 2 and 3 are longitudinal section views of the connector of the present invention exploded and assembled, with an end of the coaxial cable positioned to be inserted shown in FIG. 3.
Figure 3:
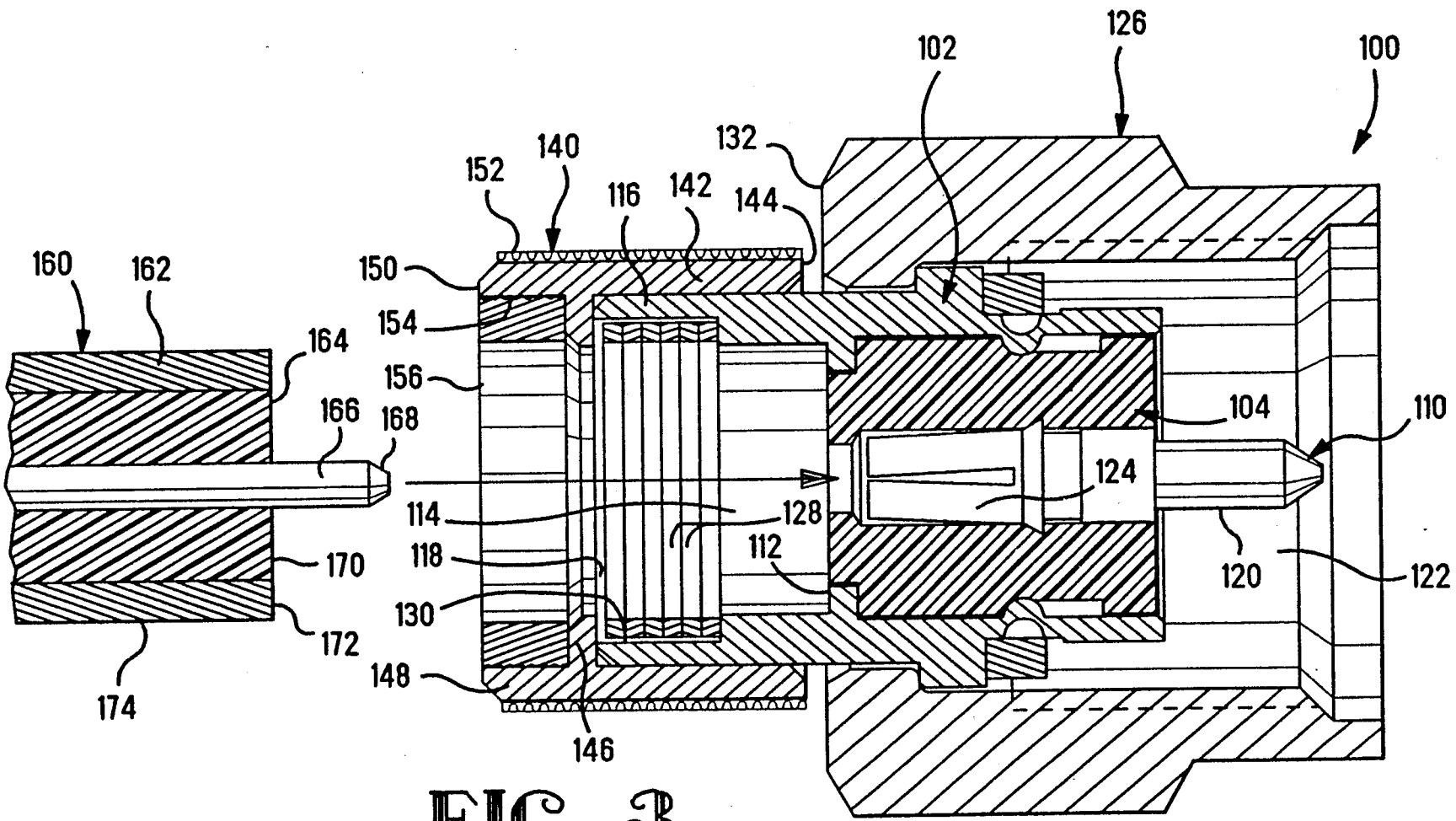
Figure 4:
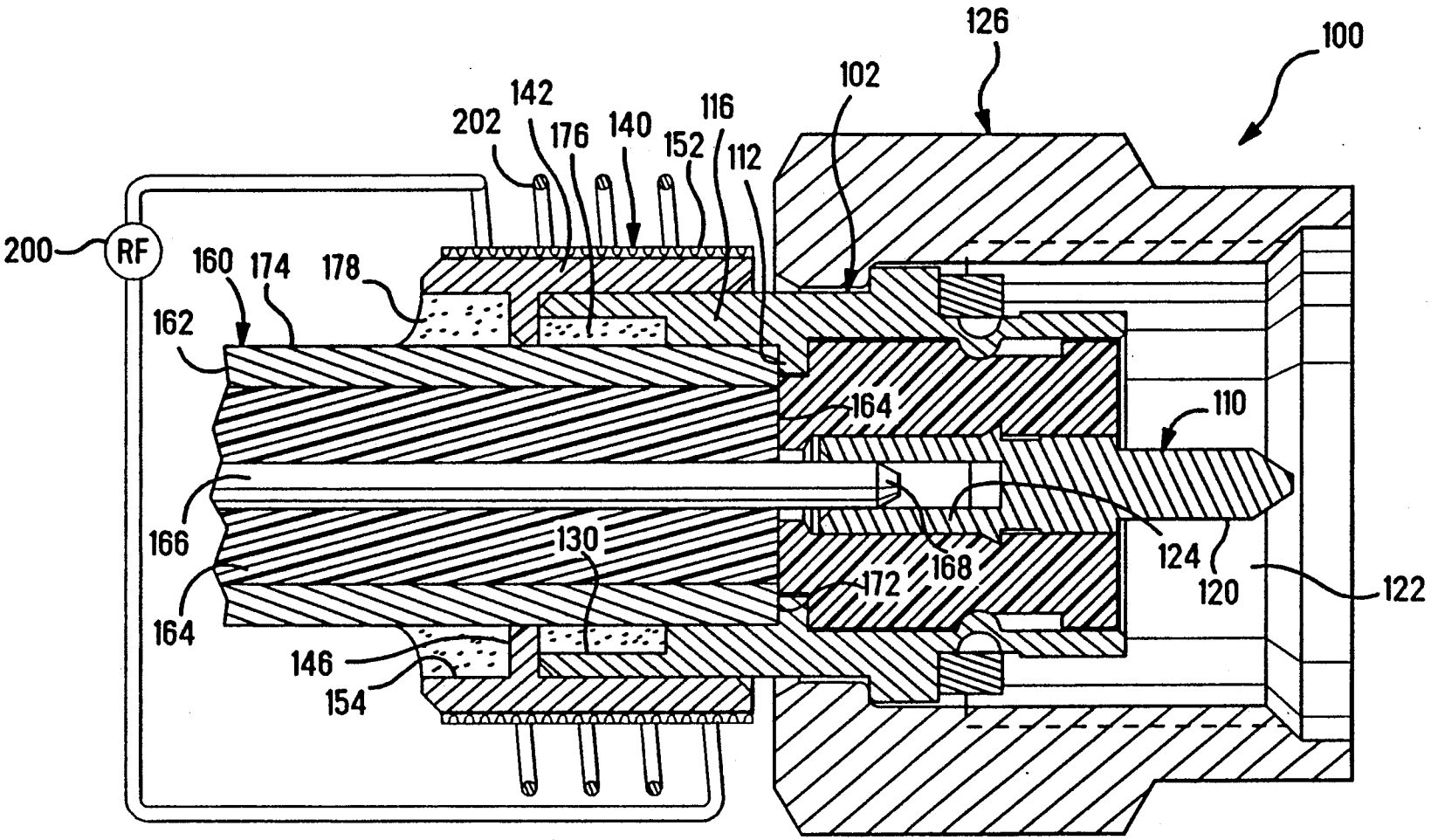
FIG. 4 is a longitudinal section view of the assembled connector soldered to the outer cable conductor by induction of RF current in the retention sleeve having reflowed the solder.

FIGS. 2 to 4 are directed to the present invention and illustrate connector assembly 100 having an outer conductor 102 in which dielectric sleeve 104 is disposed within forward section 106 and staked at 108 to be retained therewithin, with inner contact 110 contained within dielectric sleeve 104, similar to corresponding components of connector 10 of FIG. 1 and defining a subassembly. Outer conductor 102 includes annular flange 112 defining the inward end of cable-receiving bore 114 which extends through rearward section 116 to cable-receiving end 118. Inner contact 110 includes a forward contact section 120 along mating face 122 and a rearward contact section 124 recessed within dielectric sleeve 104 just forwardly of annular flange 112 concluding cable-receiving bore 114. Coupling nut 126 is identical to coupling nut 14 of FIG. 1 and is retained on and around outer conductor 102 by retention sleeve 140 of the present invention which also retains solder preforms 128 within recess 130 along cable receiving bore 114 at rearward cable-receiving end 118 of rearward section 116 similarly to connector 10 of FIG. 1.

Retention sleeve 140 includes a forward portion 142 extending to leading end 144, a radially inwardly directed flange 146, and a rearward portion 148 extending to rearward cable-receiving end 150. The inner diameter of forward portion 142 is selected to be incrementally less than the outer diameter of rearward section 116 of outer conductive housing 102, to define an interference fit securing retention sleeve 140 to outer conductive housing 102 upon assembly, as with retention sleeve 30 of PRIOR ART connector 10 of FIG. 1. Annular flange 146 retains solder preforms 128 within recess 130 of rearward section 116 upon assembly. Leading end 144 provides a rearward stop for coupling nut 126 in association with rear face 132 thereof. Retention sleeve 140 includes on its outer surface a layer 152 of high resistivity metal of high magnetic permeability as in retention sleeve 30. Rearward portion 148 includes a recess 154 rearwardly of annular flange 146 into which is insertable an annular solder preform 156 during cable termination. Preferably solder preform 156 is held within recess 154 by being pressfit thereinto, with the material of the solder preform being plastic in consistency as is conventional to be deformed slightly after being inserted, and with the axial length of the preform selected to initially exceed the depth of the recess to extend incrementally outwardly (such as by 0.005 inches) to be manually pressed carefully into the recess.

Preferably leading end 144 includes a chamfered inner peripheral surface to facilitate being received over rearward end 118 of outer conductive housing 102. The inner diameter of body section 142 of retention sleeve 140 may be selected to be about 0.002 inches less than the outer diameter of rearward section 116 of outer conductive housing 102 to generate a sufficient interference fit therebetween upon assembly. Retention sleeve 140 may be made from a metal of low resistance and minimal magnetic permeability, such as by being machined from tubular stock of beryllium copper or brass or non-magnetic stainless steel, and gold plated over nickel underplaying if desired. Outer or second layer 152 can be intimately joined to the outer surface of retention sleeve 140 such as by cladding. Second layer is formed from metal having high resistance and high magnetic permeability such as Alloy 42 having 42 percent nickel, 58 percent iron, for example, and of a thickness comprising at least one skin depth for such metal, such as about 0.0015 inches or between 0.0010 to 0.0020 inches. The bimetallic structure so formed comprises a Curie point self-regulating temperature thermal energy source achieving a temperature sufficient to reflow the solder when subjected to radiofrequency current, in a manner as is generally disclosed in U.S. Pat. Nos. 4,256,945 and 4,659,912. One example of solder material is Sn 63 tin-lead having a reflow temperature of 183° C.

Semirigid coaxial cable 160 (FIGS. 3 and 4) includes a semirigid outer conductor 162, insulative jacket 164 and inner conductor 166 having an end portion 168 extending forwardly from front end 170 of the insulative jacket and front end 172 of the outer conductor. In FIG. 4 the end portion of cable 160 has been inserted into cable-receiving bore 114 of outer conductive housing 102 until front end 172 of outer conductor 162 abuts inwardly directed flange 112, with end portion 168 of inner conductor 166 electrically mated with socket contact section 124 of inner contact 110 of connector 100. Rearward section 116 of outer conductive housing 102 with retention sleeve 140 thereon and containing the end portion of cable 160 inserted thereinto is placed within a coil 202 of generator 200 of radiofrequency current such as are disclosed in U.S. Pat. Nos. 4,626,767 and 4,789,767, which can produce an RF current of about 13.56 megaHertz.

The generator is then activated for a length of time such as about 5 seconds which activates the integral Curie point heater defined by the bimetallic structure of retention sleeve 140 to generate thermal energy until the Curie temperature is achieved, above which the Curie point heater will not rise, such as 240° C. A temperature is achieved at outer conductor 162 of cable 160 adjacent solder preforms 128 and 156 (183° C.) sufficient to reflow the solder which wets along semirigid conductor 162 and forms respective solder joints 176,178 both forwardly and rearwardly of annular flange 146 of retention sleeve 140, between the outer surface of outer conductor 162 of cable 160 and the inner surface of cable-receiving bore 114 of outer conductive housing 102 and also annular flange 146 of retention sleeve 140.

The present invention provides solder material not only forwardly of annular flange 146 of retention sleeve 140 to assure soldering of the end portion of outer conductor 162 of cable 160 to outer conductive housing 102, but also includes a site to permit a solder joint rearwardly of annular flange 146 of retention sleeve 140 assuring a robust mechanical joint of connector 100 with cable 160 by firmly anchoring annular flange 146 to the cable both axially forwardly and rearwardly thereof which better resists stress. The additional solder provided rearwardly of the annular flange assures elimination of any air gap which might otherwise form adjacent the annular flange, which could have tended to weaken the joint of the connector to the cable.

The embodiment of the coaxial connector described herein can also be soldered by conventional methods such as a soldering iron if the RF supply normally used is unavailable.

Variations and modifications to the specific embodiment disclosed herein may be devised which are within the spirit of the invention and the scope of the claims.

What is claimed is:

1. An improved coaxial connector of the type having an outer conductive housing applicable to an end of a coaxial cable having a semirigid outer conductor, with a rearward section adapted to receive an end of the cable into a cable-receiving bore thereof and a retention sleeve insertable over the rearward section from a rearward end thereof in an interference fit and having an inwardly directed annular flange adjacent the rearward end of the rearward section to retain at least one annular solder preform within a recess adjacent the rearward end of the rearward section to be reflowed to solder the outer conductive housing to the semirigid outer conductor of the cable, the improvement comprising:

said retention sleeve including a rearward portion extending rearwardly of said inwardly directed annular flange enabling solder to be disposed therein, whereby the solder when reflowed defines a solder joint with the semirigid outer conductor of the cable rearwardly of the annular flange, together with the solder joint forwardly of the annular flange defining an assured mechanical joint of the coaxial connector with the semirigid coaxial cable.

* * * * *